US008404017B2

(12) United States Patent
Tanaka et al.

(10) Patent No.: US 8,404,017 B2
(45) Date of Patent: Mar. 26, 2013

(54) HOT BRIQUETTE IRON AND METHOD FOR PRODUCING THE SAME

(75) Inventors: Hidetoshi Tanaka, Shinagawa-ku (JP); Takeshi Sugiyama, Kobe (JP)

(73) Assignee: Kobe Steel, Ltd., Kobe-shi (JP)

( * ) Notice: Subject to any disclaimer, the term of this patent is extended or adjusted under 35 U.S.C. 154(b) by 385 days.

(21) Appl. No.: 12/515,068

(22) PCT Filed: Nov. 7, 2007

(86) PCT No.: PCT/JP2007/071618

§ 371 (c)(1),
(2), (4) Date: May 15, 2009

(87) PCT Pub. No.: WO2008/059739

PCT Pub. Date: May 22, 2008

(65) Prior Publication Data

US 2010/0068088 A1 Mar. 18, 2010

(30) Foreign Application Priority Data

Nov. 16, 2006 (JP) ..... 2006-310047

(51) Int. Cl.
*C22B 1/24* (2006.01)

(52) U.S. Cl. ..... 75/316; 75/317; 75/255; 428/570

(58) Field of Classification Search ..... 75/316, 75/770, 504, 317; 428/570
See application file for complete search history.

(56) References Cited

U.S. PATENT DOCUMENTS

| | | | | |
|---|---|---|---|---|
| 3,556,772 | A * | 1/1971 | Rausch et al. | 75/436 |
| 4,093,455 | A * | 6/1978 | Pietsch | 75/316 |
| 5,730,775 | A | 3/1998 | Meissner et al. | |
| 6,030,434 | A * | 2/2000 | Machado Zuloaga et al. | 75/770 |
| 6,096,112 | A | 8/2000 | Masso et al. | |
| 6,235,085 | B1 * | 5/2001 | Masso et al. | 75/770 |
| 6,342,089 | B1 * | 1/2002 | McGaa | 75/319 |
| 6,368,379 | B1 | 4/2002 | Tateishi et al. | |
| 6,955,730 | B2 * | 10/2005 | Bockel-Macal et al. | 148/511 |
| 2002/0178864 | A1 * | 12/2002 | Watanabe et al. | 75/317 |
| 2004/0076539 | A1 | 4/2004 | Ito et al. | |
| 2007/0295165 | A1 | 12/2007 | Tanaka et al. | |

FOREIGN PATENT DOCUMENTS

| | | | |
|---|---|---|---|
| EP | 0 927 770 | A1 | 7/1999 |
| EP | 0 947 586 | A1 | 10/1999 |
| JP | 11 302714 | | 11/1999 |
| JP | 2000-109937 | | 4/2000 |

(Continued)

OTHER PUBLICATIONS

Examination Report issued Aug. 4, 2011 in New Zealand Patent Application No. 577224.

(Continued)

*Primary Examiner* — George Wyszomierski
*Assistant Examiner* — Tima M McGuthry Banks
(74) *Attorney, Agent, or Firm* — Oblon, Spivak, McClelland, Maier & Neustadt, L.L.P.

(57) ABSTRACT

Hot briquette iron includes a plurality of reduced iron particles which are bonded to each other by hot forming, wherein the reduced iron particles each have a surface region having an average carbon content of 0.1 to 2.5% by mass and a central region positioned inside the surface region and having an average carbon content higher than that of the surface region.

8 Claims, 5 Drawing Sheets

FOREIGN PATENT DOCUMENTS

| | | |
|---|---|---|
| JP | 2000 109937 | 4/2000 |
| JP | 2001 181721 | 7/2001 |
| JP | 2002 517607 | 6/2002 |
| JP | 2006 152432 | 6/2006 |
| TW | 531560 | 5/2003 |
| TW | 200613566 | 10/2005 |

OTHER PUBLICATIONS

Hidetoshi Tanaka, et al., "HIB Production through Coal-based Direct Reduction and Its Application in Blast Furnace", Journal of the Iron and Steel Institute of Japan, vol. 92, No. 12, pp. 1022-1028, (Dec. 1, 2006)(with Partial English translation).

Yutaka Ujisawa, et al., "Effect of HBI Utilization of Blast Furnace Productivity" , Iron and Steel, vol. 92, No. 10, pp. 591-600, 2006. (with partial English translation).

Ken Sugiyama, et al., "Dust Processing by FASTMET$^{R}$ Method", The 2001 Fall Meeting of the Mining and Materials Processing Institute of Japan, 2 Pages, (Sep. 24-26, 2001). (with partial English translation).

Office Action dated on Aug. 19, 2010, in Taiwanese Patent Application No. 096142619 (with English Translation).

Extended Search Report issued Mar. 21, 2011 in International Application No. 07831349.1.

Japanese Office Action issued Oct. 18, 2011, in Patent Application No. 2006-310047 (English-language translation only).

* cited by examiner

HOT BRIQUETTE IRON AND METHOD FOR PRODUCING THE SAME

This application is a 371 of PCT/JP2007/71618, filed Nov. 7, 2007, which claims priority under 35 U.S.C. §119 of Japanese Patent Application No. 2006-310047, filed Nov. 16, 2006.

TECHNICAL FIELD

The present invention relates to a technique for producing hot briquette iron (may be abbreviated to "HBI" hereinafter) using reduced iron which is obtained by heating reduction of agglomerates incorporated with a carbonaceous material, and particularly to HBI suitable as a raw material to be charged in a blast furnace and a method for producing the same.

BACKGROUND ART

HBI has attracted attention as a raw material to be charged in a blast furnace which can cope with problems of both the recent tendency to higher tapping ratio operations and reduction of $CO_2$ emission (refer to, for example, Non-patent Document 1).

However, conventional HBI is produced by hot forming of so-called gas-based reduced iron (reduced iron may be abbreviated to "DRI" hereinafter) which is produced by reducing fired pellets with high iron grade, which is used as a raw material, with reducing gas produced by reforming natural gas. Therefore, conventional gas-based HBI is used as a raw material alternative to scraps in electric furnaces, but has a problem in practical use because of its high cost as a raw material for blast furnaces.

On the other hand, there has recently been developed a technique for producing so-called coal-based DRI by reducing, in a high-temperature atmosphere, a low-grade iron raw material with agglomerates incorporated with a carbonaceous material, which contain inexpensive coal as a reductant, and practical application of the technique has been advanced (refer to, for example, Patent Document 1). The coal-based DRI contains large amounts of gangue content (slag content) and sulfur content (refer to Example 2 and Table 7 described below) and is thus unsuitable for being directly charged in an electric arc furnace. In contrast, when the coal-based DRI is used as a raw material to be charged in a blast furnace, large amounts of slag content and sulfur content are not so important problem. In addition, the coal-based DRI has a merit that it can be produced at low cost as compared with conventional HBI.

However, in order to use the coal-based DRI as a raw material to be charged in a blast furnace, DRI is required to have strength enough to resist charging in a blast furnace. The coal-based DRI is produced using a carbonaceous material incorporated as a reductant and thus has high porosity and a high content of residual carbon as compared with gas-based DRI. Therefore, the coal-based DRI has lower strength than that of gas-based DRI (refer to Example 2 and Table 7 described below). Consequently, there is a condition in which in order to directly use the coal-based DRI as a raw material to be charged in a blast furnace, the amount of the carbonaceous material mixed is decreased to extremely decrease the content of residual carbon in DRI (may be abbreviated to "carbon content" (C content) hereinafter), and strength is secured even by the sacrifice of metallization (refer to FIG. 3 of Non-patent Document 2). In addition, like the gas-based DRI, the coal-based DRI is easily re-oxidized and thus does not have weather resistance. Therefore, the coal-based DRI has a problem of being unsuitable for long-term storage and long-distance transport.

Non-Patent Document 1: Y Ujisawa, et al. Iron & Steel, vol. 92 (2006), No. 10, p. 591-600

Non-Patent Document 2: Takeshi Sugiyama et al. "Dust Treatment by FASTMET (R) Process", Resource Material (Shigen Sozai) 2001 (Sapporo), Sep. 24-25, 2001, 2001 Autumn Joint Meeting of Resource Materials-Related Society (Shigen Sozai Kankeigaku Kyokai)

Patent Document 1: Japanese Unexamined Patent Application Publication No 2001-181721

DISCLOSURE OF INVENTION

The present invention has been achieved in consideration of the above-mentioned situation, and an object of the present invention is to provide inexpensive hot briquette iron having strength as a raw material to be charged in a blast furnace and weather resistance. Another object of the present invention is to provide a method for producing the hot briquette iron.

In order to achieve the objects, hot briquette iron in an aspect of the present invention includes a plurality of reduced iron particles which are bonded to each other by hot forming, the reduced iron particles having a surface region having an average carbon content of 0.1 to 2.5% by mass and a central region positioned inside the surface region and having an average carbon content higher than that of the surface region.

In order to achieve the objects, a method for producing hot briquette iron in another aspect of the present invention includes an agglomeration step of granulating agglomerates incorporated with a carbonaceous material, which contain an iron oxide content and a carbonaceous material, a heat reduction step of heat-reducing the agglomerates incorporated with the carbonaceous material in a reducing furnace to produce reduced iron particles having an average carbon content of 0.1 to 2.5% by mass in a surface region and a higher average carbon content in a central region than that in the surface region, a discharge step of discharging a plurality of reduced iron particles from the reducing furnace, and a hot forming step of compression-molding the a plurality of the reduced iron particles discharged from the reducing furnace with a hot-forming machine.

BEST MODE FOR CARRYING OUT THE INVENTION

First, the possibility of hot briquetting of coal-based DRI is described. A raw material to be charged in a blast furnace is required to have strength enough to resist charging in a blast furnace. Therefore, for the purpose of imparting strength necessary as a raw material to be charged, coal-based DRI may be agglomerated into briquettes by hot forming (hot briquetting into HBI). However, when coal-based DRI having a high residual C content is used, HBI having sufficient strength cannot be obtained according to a technical common knowledge of hot briquetting of conventional gas-based DRI.

In other words, as a technical common knowledge of hot briquetting of gas-based DRI to produce HBI, when gas-based HBI is used in an electric furnace, DRI is desired to have as a high C content as possible because the power consumption is reduced by reduction of unreduced ion oxide in DRI. However, it is known that the strength of HBI is decreased by increasing the C content in DRI, and thus the C content of DRI is limited to about 1.8% by mass at most. Therefore, even when the technique of hot briquetting gas-based DRI to HBI is used directly for coal-based DRI having a high residual carbon content and low strength as compared with gas-based DRI, coal-based HBI with sufficient strength cannot be obtained.

Hence, the inventors of the present invention examined the influence of the C content in DRI on strength of HBI when the gas-based DRI is hot briquetted to HBI.

Figure 10:
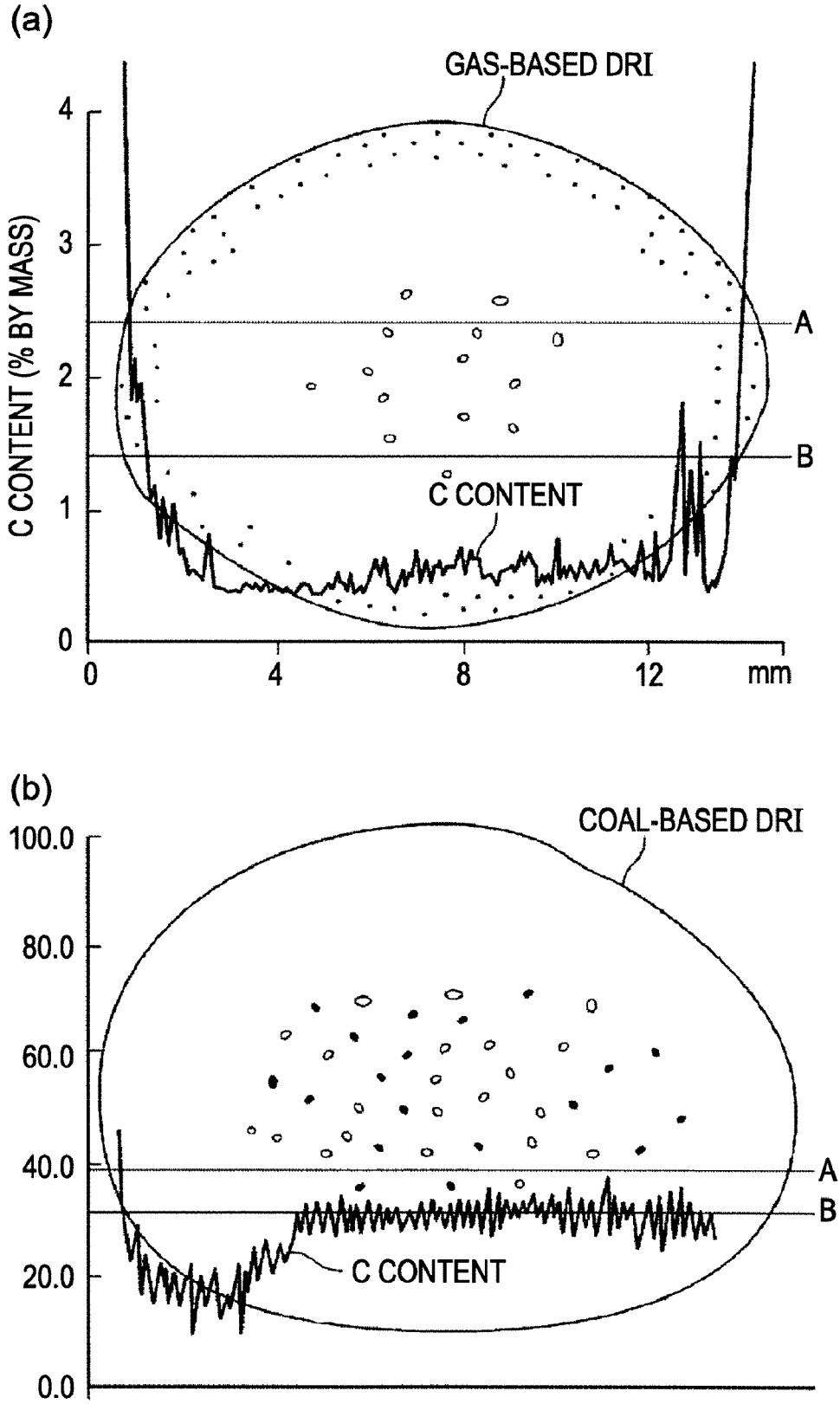
FIG. 10 is a drawing showing a carbon content distribution in DRI, in which (a) shows gas-based DRI and (b) shows coal-based DRI.

FIG. 10(*a*) schematically shows a section of gas-based DRI (diameter: about 14 mm, C content: about 1.8% by mass) before hot briquetting to HBI and a carbon content distribution (the carbon content may be abbreviated to "C content" hereinafter) in the diameter direction (lateral direction of FIG. 10(*a*)) obtained by EPMA surface analysis of a region between lines A and B of the section. In the figure, the carbon content distribution is indicated by average carbon contents in a direction (vertical direction of the figure) vertical to the lines A and B along the diameter direction (lateral direction in the figure).

FIG. 10(*a*) indicates that the C content in DRI is substantially constant at about 0.5% by mass within a central region (in a region of a diameter of about 8 mm from the center). On the other hand, the C content abruptly increases near to the periphery (i.e., the surface side). The average C content in the entire DRI of about 14 mm in diameter is about 1.8% by mass, and the average C content in the DRI central region with a diameter of about 8 mm is about 0.5% by mass. Therefore, according to balance calculation, the average C content in a DRI surface region from the surface to a depth of about 3 mm is about 2.5% by mass.

The reason why the C content abruptly increases in the surface region of gas-based DRI is that the gas-based DRI is gas-carburized from the surface of reduced iron with methane or the like which is added to reducing gas, and thus carbon (C) deposits on surfaces of metallic iron and diffuses into the metallic iron, thereby increasing the C content.

Therefore, when the C content in gas-based DRI is further increased, carbon deposition on the metallic iron surface and diffusion into the metallic iron are further increased, thereby decreasing the adhesive force between DRI particles during hot forming for briquetting to HBI. As a result, as indicated by the technical common knowledge, strength of HBI is decreased.

However, the inventors found from the above-described examination that strength of HBI (gas-based HBI) produced by hot forming from gas-based DRI is not determined by the average C content in the entire region of gas-based DRI but is defined by the average C content in the surface region of DRI which influences the adhesive force between DRI particles during hot forming. In FIG. 10(*a*), rice grain-like points (voided points) in the central region show voids, and dots in the surface region show carbon deposits (partially including iron carbide).

Next, coal-based DRI was also subjected to EPMA surface analysis of a section of DRI within a region between lines A and B shown in FIG. 10(*b*). As a result, a C content distribution as shown in FIG. 10(*b*) was obtained. FIG. 10(*b*) indicates that contrary to gas-based DRI, the C content of coal-based DRI substantially constant at a relatively high value in a central region. On the other hand, the C content abruptly decreases in a peripheral region (i.e., a surface-side region). In measurement of the C content distribution in the coal-based DRI, surface analysis was not performed in a region near the right-side surface of DRI shown in FIG. 10(*b*), and thus a C content distribution is not shown in the region near the right-side surface in FIG. 10(*b*). However, according to the results of EPMA surface analysis separately performed over the entire region of coal-based DRI, it was confirmed that the C content near the right-side surface of DRI is lower than that in the central region. (In order to prepare an EPMA sample of gas-based DRI, DRI was buried in a resin, the resin was cut into halves, and a DRI section was polished. In contrary, in order to prepare an EPMA sample of coal-based DRI, DRI was cut, voids of a section were filled with a resin, and then the section was polished because a central region of DRI was very porous and thus could not be polished directly. Therefore, quantitative analysis of the C content could be performed over the entire region of gas-based DRI, but it was difficult to quantitatively determine the C content with high precision within a central region of coal-based DRI because the influence of carbon content in the resin. Therefore, only the results of qualitative analysis were obtained. In FIG. 10(*b*), rice grain-like points (voided points) in the central region show voids, and sesame grain-like points (black points) show carbon and carbon-containing iron.)

Although described in detail below, the reason why the C content of coal-based DRI abruptly decreases in the surface region is that the carburization mechanism of the coal-based DRI is different from that of gas-based DRI, and the temperature in the surface region of the coal-based DRI is rapidly increased by radiation heating within a short time as compared with the central region, thereby increasing the amount of the carbonaceous material consumed by solution loss reaction as compared with the central region.

Therefore, it is thought that if the average C content of the surface region of coal-based DRI is specified (suppressed) to 2.5% by mass or less which is an upper limit of the average C content in the surface region of the gas-based DRI, strength of HBI produced from such coal-based DRI can be secured to be equivalent to that of HBI produced from gas-based DRI. As a result of further investigation, the present invention has been achieved.

The configuration of the present invention is described in detail below.

[Configuration of HBI]

Hot briquette iron according to the present invention is produced by hot-forming a plurality of reduced iron particles, and the reduced iron particles include a surface region having an average C content of 0.1 to 2.5% by mass and a central region disposed inside the surface region and having an average C content higher than that of the surface region.

Hereafter, the reason for employing the above-described configuration and the reason for limiting values are described.

Hot briquette iron according to the present invention is produced by hot-forming a plurality of reduced iron particles into briquettes. The reduced iron particles are compression-deformed through hot forming so that adjacent reduced iron particles adhere to each other at the surfaces. The reason for specifying "the average C content in surface regions" of reduced iron particles is that it is thought that the adhesive force between the reduced iron particles, which determines strength of HBI when HBI is formed by compression-molding a plurality of reduced iron particles, is determined depending on the amount of carbonaceous material particles present in metallic iron portions in the surface regions of reduced iron particles.

The "surface regions of reduced iron particles" are preferably regions from the surfaces of reduced iron particles to a depth of about 1 to 5 mm. If the depth from the surface is less than about 1 mm, the thickness of a low-carbon surface region is excessively small, and thus adhesion between reduced iron particles becomes insufficient. On the other hand, when the depth is over about 5 mm, the average carbon content of coal-based reduced iron is excessively decreased. Therefore, the regions are more preferably regions from the surfaces of DRI to a depth of about 3 mm to which deformation due to compression molding extends.

The reason for specifying the average C content in the surfaces regions of reduced iron particles to "0.1 to 2.5% by mass" is that if the average C content exceeds 2.5% by mass, the amount of carbonaceous material particles present in metallic iron portions in the surface regions of reduced iron particles is excessively increased, thereby decreasing the adhesion between reduced iron particles. On the other hand, if the average C content is less than 0.1% by mass, metallic iron in the surfaces regions of reduced iron particles is easily re-oxidized to increase the amount of iron oxide instead of decreasing the amount of metallic iron. Therefore, adhesive force between reduced iron particles is decreased. The lower limit of the average C content in the surface regions of reduced iron particles is more preferably 0.3% by mass, particularly 0.5% by mass, and the upper limit of the average C content in the surface regions of reduced iron particles is more preferably 2.0% by mass, particularly 1.5% by mass.

The reason for specifying the average C content in the central region so that it is higher than that of the surface regions of reduced iron particles is that even when the average C content in the surface regions is set to be low, the average C content in the central regions is set to be higher than that in the surface regions to maintain the average C content at a certain high value over the entire regions of reduced iron particles, thereby achieving the effect of preventing re-oxidation with $CO_2$-rich gas in a shaft portion in a blast furnace and the effect of easy melt-down due to carburization in a high-temperature portion.

It is recommended that the reduced iron particles each include only the surface region and the central region.

The average C content of the whole of reduced iron particles constituting HBI is preferably 1.0 to 5.0% by mass. When the average C content is less than 1.0% by mass, it is impossible to sufficiently achieve the effect of preventing re-oxidation with $CO_2$-rich gas in a shaft portion in a blast furnace and the effect of easy melt-down due to carburization in a high-temperature portion. On the other hand, when the average C content exceeds 5.0% by mass, the C content in the central region of coal-based DRI become excessive, thereby increasing the possibility of decreasing strength of HBI with decrease in strength of coal-based DRI. The lower limit of the average C content in the whole of reduced iron particles is more preferably 2.0% by mass, particularly 3.0% by mass, and the upper limit of the average C content is more preferably 4.5% by mass, particularly 4.0% by mass.

In addition, the metallization degree of reduced iron particles constituting HBI is preferably 80% or more, more preferably 85% or more, and particularly preferably 90% or more. This is because when the metallization degree is increased, the effect of further increasing production in a blast furnace and the effect of decreasing the ratio of a reducing material can be obtained.

[Method for Producing HBI]

Figure 1:
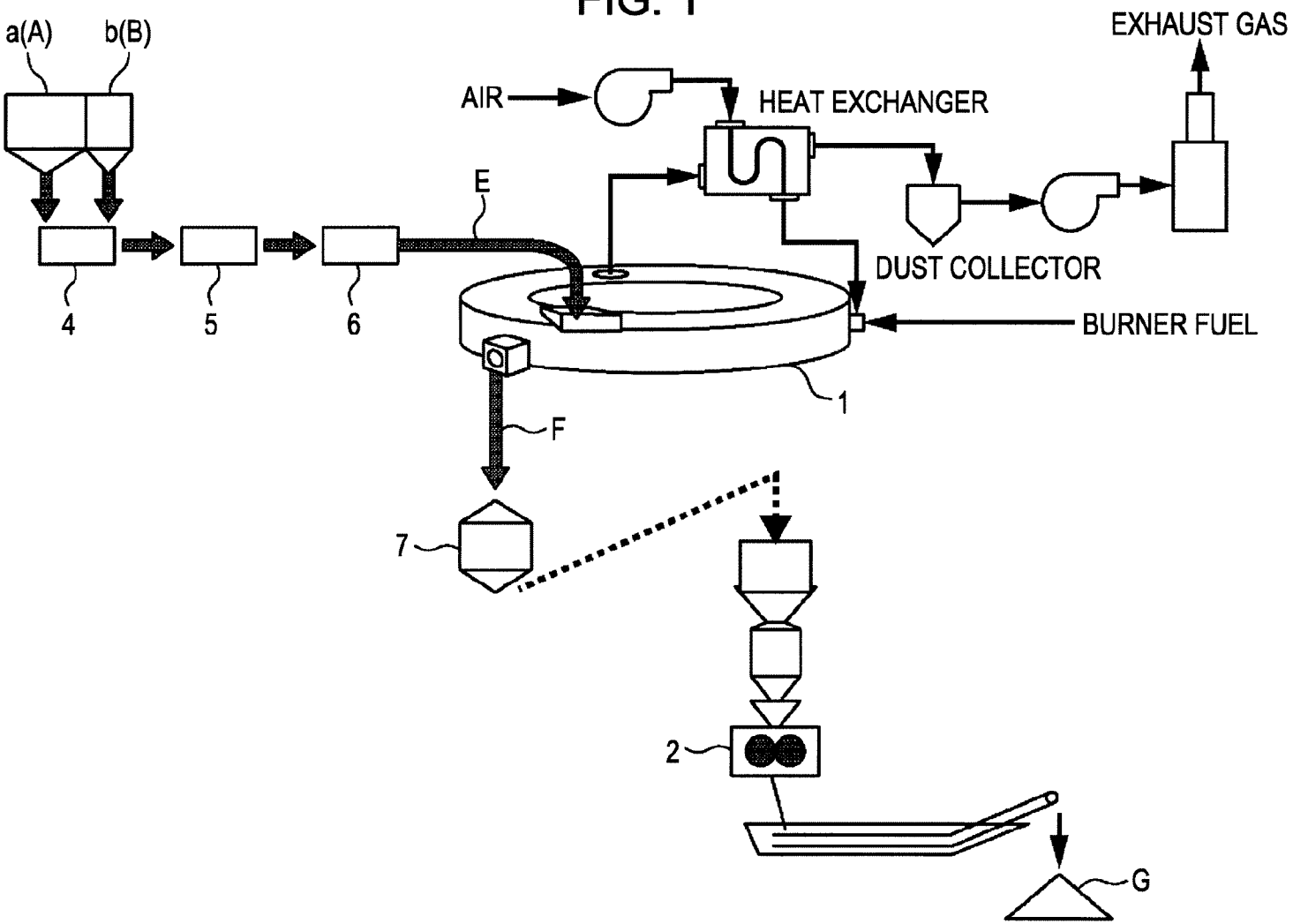
FIG. 1 is a flow diagram showing the outlines of a HBI production flow according to an embodiment of the present invention.

The method for producing HBI is described with reference to a schematic production flow shown in FIG. 1. In FIG. 1, reference numeral 1 denotes a rotary hearth furnace serving as a reducing furnace for heat-reducing agglomerates containing an iron oxide content and a carbonaceous material to produce DRI, and reference numeral 2 denotes a hot briquetting machine serving as a hot-forming machine for hot compression-molding DRI to produce HBI. Further detailed description is made according to the production flow.

(1) Agglomeration Step

According to demand, iron ore a as an iron oxide content and coal b as a carbonaceous material are separately ground to prepare respective powders having a particle size of less than about 1 mm. The resultant powdery iron ore A and powdery coal B are mixed at a predetermined ratio. The mixing ratio of the powdery coal B is determined to include an amount necessary for reducing the powdery iron ore A to metallic iron and an average C content (for example, 2.0 to 5.0% by mass) allowed to remain in reduced iron F after reduction. Further, if required, appropriate amounts of a binder and water are added (an auxiliary raw material may be added as a flux). These materials are mixed in a mixer 4 and then granulated to a particle size of about 6 to 20 mm with a granulator 5, preparing pellets E incorporated with the carbonaceous material as agglomerates incorporated with a carbonaceous material.

The pellets E incorporated with the carbonaceous material are preferably dried to a moisture content of about 1% by mass or less with a dryer 6 in order to prevent bursting in a rotary hearth furnace 14.

(2) Heat Reduction Step

Then, the dried pellets E incorporated with the carbonaceous material are placed in a thickness of one or two layers on the hearth (not shown) of the rotary hearth furnace 14 using a charging device (not shown). The pellets E incorporated with the carbonaceous material which are placed on the hearth are heated and passed through the rotary hearth furnace 1. Specifically, the pellets E incorporated with the carbonaceous material are passed through the rotary hearth furnace 1 heated to an atmospheric temperature of 1100 to 1400° C., preferably 1250 to 1350° C., for a retention time of 6 minutes or more, preferably 8 minutes or more.

As means (heating means) for heating the pellets E incorporated with the carbonaceous material, for example, a plurality of burners (not shown) provided on an upper portion of the wide wall of the rotary hearth furnace 1 can be used.

The pellets E incorporated with the carbonaceous material are heated by radiation during passage through the rotary hearth furnace 1. As a result, the iron oxide content in the pellets E incorporated with the carbonaceous material is metallized by reduction with the carbonaceous material according to chain reactions represented by the formulae (1) and (2) below, producing solid reduced iron F.

$$Fe_xO_y+yCO \rightarrow xFe+yCO_2 \quad \text{Formula (1)}$$

$$C+CO_2 \rightarrow 2CO \quad \text{Formula (2)}$$

The reaction conditions produced in the pellets E incorporated with the carbonaceous material are described in detail below.

When the pellets E incorporated with the carbonaceous material are heated by radiation in the rotary hearth furnace 1, the temperature of the surface regions of the pellets E incorporated with the carbonaceous material are increased ahead of the central regions and maintained in a high-temperature condition for a long time. Therefore, the carbonaceous material present near the surfaces is more consumed by the solution loss reaction represented by the formula (2) than the carbonaceous material present in the central regions. In addition, in the central region, CO produced by the solution loss reaction represented by the formula (2) is converted to $CO_2$ by reduction reaction with the iron oxide content represented by the formula (1). Further, $CO_2$ produced in the central region further consumes the carbonaceous material present in the surface region when passing through the surface region and flowing to the outside of the pellets E incorporated with the carbonaceous material. As a result, the C content in the surface region is lower than that in the central region as shown in FIG. 10(*b*).

As described above, the average C content in the surface regions of the reduced iron particles F produced from the pellets E incorporated with the carbonaceous material is lower than that in the central regions (i.e., the average C content in the central regions of the coal-based reduced iron particles F is higher than that in the surface regions).

It is necessary that the average C content in the surface regions of the reduced iron particles F is within a predetermined range (0.1 to 2.5% by mass). In order to adjust the average C content in the surface regions to 0.1 to 2.5% by mass, the mixing ratio of the carbonaceous material in the pellets E incorporated with the carbonaceous material, and the operation conditions of the rotary hearth furnace 1, such as the atmospheric temperature in the rotary hearth furnace 1, the retention time of the pellets E incorporated with the carbonaceous material in the rotary hearth furnace 1, and the like, may be appropriately controlled. For example, the mixing ratio of the carbonaceous material, the atmospheric temperature, and the retention time may be controlled to 10 to 26%, 1250 to 1400° C., and 8 to 30 minutes, respectively. In particular, the carbon mixing amount is preferably an amount including a carbon amount corresponding to the carbon mole which is equal to the oxygen mole removed from the agglomerates incorporated with the carbonaceous material (for example, the pellets E incorporated with the carbonaceous material) plus 3%. On the other hand, the operation conditions are preferably conditions in which the agglomerates incorporated with the carbonaceous material are bedded in one or two layers on the hearth, the temperature directly above the agglomerates is kept at 1300° C., and heating is performed until the metallization degree reaches 90% or more.

Also, it is recommended that the average C content in the whole of the reduced iron particles F is 1.0 to 5.0% by mass. As described above, the average C content in the whole of the reduced iron particles F may be controlled by the mixing ratio of the carbonaceous material in the pellets E incorporated with the carbonaceous material. In this case, the mixing ratio is influenced by the operation conditions, such as the atmospheric temperature in the rotary hearth furnace 1, the retention time of the pellets E incorporated with the carbonaceous material in the rotary hearth furnace 1, and the like, and thus the mixing ratio is controlled in consideration of these operation conditions. In other words, the mixing ratio of the carbonaceous material to the iron oxide content in the agglomeration step and/or the operation conditions of the rotary hearth furnace 1 in the heat-reduction step may be controlled so that the average C content in the whole of the reduced iron particles F is 1.0 to 5.0% by mass.

In addition, it is recommended that the metallization degree of the reduced iron F is 80% or more. Since the amount of the coal (carbonaceous material) b mixed in the pellets E incorporated with the carbonaceous material exceeds an amount necessary for reduction of the iron ore (iron oxide content) a, the metallization degree can be easily achieved by appropriately controlling the operation conditions, such as the atmospheric temperature in the rotary hearth furnace 1, the retention time of the pellets E incorporated with the carbonaceous material in the rotary hearth furnace 1, and the like. In other words, the mixing ratio of the carbonaceous material to the iron oxide content in the agglomeration step and/or the operation conditions of the rotary hearth furnace 1 in the heat-reduction step may be controlled so that the metallization degree of the reduced iron F is 80% or more.

(3) Discharge Step

The reduced iron particles F produced as described above are discharged at about 1000° C. from the rotary hearth furnace 1 using a discharge device (not shown).

(4) Hot Forming Step

The reduced iron particles F discharged from the rotary hearth furnace 1 are once stored in, for example, a container 7, cooled to about 600 to 650° C., which is a temperature suitable for usual hot forming, with an inert gas such as nitrogen gas, and then pressure-formed (compression forming) with, for example, a twin-roll hot briquetting machine 2, to produce hot briquette iron G. Since the average C content in the surface regions of the reduced iron particles F is adjusted to 0.1 to 2.5% by mass, the hot briquette iron G secures sufficient strength as a raw material to be charged in a blast furnace. Further, since the average C content in the central regions of the reduced iron particles F is higher than that in the surface regions, the average C content of the whole of the hot briquette iron G is kept high. Therefore, when the hot briquette iron G is charged in a blast furnace, it is possible to achieve the effect of preventing re-oxidation with $CO_2$-rich furnace gas in a shaft portion in the blast furnace and the effect of easy melt-down due to carburization in metallic iron in a high-temperature portion of blast furnace.

Modified Example

In an example described in the embodiment, the average C content in the surface regions of the reduced iron particles F is adjusted by controlling the mixing ratio of the carbonaceous material to the iron oxide content in the agglomeration step and/or controlling the operation conditions of the rotary hearth furnace 1 in the heat-reduction step. In another embodiment of the present invention, instead of or in addition to the control, the oxidation degree of a gas atmosphere may be changed in a zone immediately before the reduced iron F discharge portion in the rotary hearth furnace 1, the zone corresponding to the time of termination of the heat-reduction step, i.e., the time when the gas generation from the pellets E incorporated with the carbonaceous material is decreased or stopped. This is because the consumption of the carbonaceous material in the surface regions of the reduced iron F can be adjusted. When the oxidation degree of the gas atmosphere is changed, the average C content in the surface regions of the reduced iron F can be more precisely controlled. The oxidation degree of the gas atmosphere in a predetermined zone in the rotary hearth furnace 1 can be easily changed by changing the air ratio of a burner provided in the zone. For example, when the average C content in the surface regions of the reduced iron F exceeds 2.5% by mass, the air ratio of the burner may be increased to increase the oxidation degree of the gas atmosphere. Consequently, the consumption of the carbonaceous material in the surface regions of the reduced iron F is promoted so that the average C content in the surface regions of the reduced iron F can be maintained at 2.5% by mass or less (first step of controlling the C content in the surface regions of reduced iron).

Further, after the reduced iron F is discharged from the rotary hearth furnace 1, a predetermined amount of oxidizing gas may be brought into contact with the reduced iron F for a predetermined time by, for example, spraying, as the oxidizing gas, air or burner combustion exhaust gas of the rotary hearth furnace 1 on the reduced iron F. In this case, the consumption of the carbonaceous material in the surface regions of the reduced iron F can be controlled (second step of controlling the C content in the surface regions of reduced iron).

In addition, any one of the first and second steps of controlling the C content in the surface regions of reduced iron may be performed, or both steps may be combined.

Although, in an example described in the embodiment, the reduced iron particles F at about 1000° C. discharged from the rotary hearth furnace 1 are cooled to about 600 to 650° C. and then hot-formed, forming can be performed at an increased hot-forming temperature without substantially cooling the reduced iron particles F, i.e., without such a forced cooling operation as described above. In this case, the heat resistance of the hot briquetting machine 2 becomes a problem, but the problem can be dealt with by enhancing water cooling of the roll, improving the quality of the roll material, or the like. Even when the C content of the whole of the reduced iron particles F in the hot briquette iron G is as high as about 5% by mass, high strength can be secured by forming at an increased hot forming temperature.

Although, in the embodiment, iron ore is used as the iron oxide content a, blast furnace dust, converter dust, electric furnace dust, or steel plant dust such as mill scales, which contains iron oxide, can be used instead of or in addition to the iron ore.

Although, in the embodiment, coal is used as the carbonaceous material b, coke, oil coke, charcoal, wood chips, waste plastic, a scrap tire, or the like can be used instead of or in addition to the coal. In addition, the carbon content in blast furnace dust may be used.

Although, in the embodiment, the pellets incorporated with the carbonaceous material are used as the agglomerates incorporated with the carbonaceous material and are granulated by a granulator, briquettes incorporated with a carbonaceous material (briquettes smaller than hot briquette iron) may be used instead of the pellets incorporated with the carbonaceous material and compression-molded with a pressure forming machine. In this case, water is not added during forming according to the type of binder used, but rather a dried raw material may be used.

Although, in this embodiment, a rotary hearth furnace is used as a reducing furnace, a linear furnace may be used instead of the rotary hearth furnace.

Examples

Example 1

In order to examine the average C content in each of a surface region and a central region of coal-based DRI, a reduction test described below was performed as a simulation of the heat reduction step using a rotary hearth furnace.

Auxiliary materials were added to coal and iron ore having the compositions shown in Table 1 and mixed at the mixing ratio shown in Table 2. Then, an appropriate amount of water was added to the resultant mixture, and the mixture was granulated by a small disk pelletizer and then sufficiently dried by maintaining in a dryer to prepare sample pellets incorporated with a carbonaceous material having an average particle size of 18.7 mm. In Table 1, "−74 μm" indicates "particles with a particle diameter of 74 μm or less", and "LOI" is an abbreviation for "Loss of Ignition" and indicates a loss of mass by heating at 1000° C. for 1 hour. This applies to Table 4.

TABLE 1

| | Chemical composition (% by mass) | | | | | | | Particle size (% by mass) |
|---|---|---|---|---|---|---|---|---|
| | T.Fe | $Fe_3O_4$ | $SiO_2$ | $Al_2O_3$ | CaO | MgO | LOI | −74 μm |
| Iron ore | 67.64 | 93.48 | 4.7 | 0.21 | 0.47 | 0.46 | 0.13 | 96 |
| | Proximate analysis (% by mass) | | | Ultimate analysis (% by mass) | | | | Particle size |
| | Ash | VM | FC | S | C | H | O | −74 μm |
| Coal | 4.64 | 16.79 | 78.57 | 0.595 | 86.24 | 4.18 | 2.48 | 93 |

TABLE 2

| | Iron ore | Coal | Organic binder | Limestone | Dolomite |
|---|---|---|---|---|---|
| Mixing ratio (% by mass) | 72.38 | 17.0 | 0.9 | 6.28 | 2.64 |

Six sample pellets incorporated with the carbonaceous material were placed in a layer on an alumina tray and quickly inserted into a small-size horizontal heating furnace adjusted to an atmospheric temperature of 1300° C. under a stream of 100% $N_2$ at 3 NL/min. When the CO concentration in exhaust gas deceased to 5% by volume, it was considered that reduction was completed, and the sample was taken out to a cooling position and cooled to room temperature in a $N_2$ atmosphere. The resulting reduced iron sample was subjected to cross-section observation and chemical analysis. The test was repeated two times in order to confirm reproducibility.

According to the cross-section observation, it was found that in a peripheral portion of the resulting reduced iron, metallic iron is sintered by the heating treatment to form a dense region, while in a central portion, much residual carbon is contained and metallic iron not sufficiently sintered. The average particle diameter of the reduced iron was decreased to about 16 mm from the particle diameter of 18.7 mm before reduction.

Since the thickness of the dense region formed by sintering metallic iron in the peripheral portion was about 3 mm, the peripheral portion was considered to correspond to "the portion from the surface to a depth of about 3 mm", which is a recommended range of the surface region of reduce iron according to the present invention, and the central portion was considered to correspond to the central region (portion excluding the surface region). The reduced iron was separated into the peripheral portion (surface region) and the central portion (central region) and subjected to chemical analysis for each of the regions. The results of chemical analysis are shown in Table 3.

TABLE 3

| Test No. | Region | Sample dimension | Sample mass | Chemical composition (% by mass) T.Fe | FeO | T.C | Metallization degree (%) |
|---|---|---|---|---|---|---|---|
| 1 | Peripheral portion | Thickness of about 3 mm | 3.09 g | 81.15 | 0.24 | 1.57 | Not measured |
| | Central portion | Diameter of about 10 mm | 16.85 g | 78.00 | 0.30 | 4.37 | Not measured |
| | Whole | Diameter of about 16 mm | 19.94 g | 78.49 | 0.29 | 3.94 | 99.74 |
| 2 | Peripheral portion | Thickness of about 3 mm | 3.37 g | 80.94 | 0.24 | 1.50 | Not measured |
| | Central portion | Diameter of about 10 mm | 16.86 g | 76.75 | 0.26 | 4.48 | Not measured |
| | Whole | Diameter of about 16 mm | 20.23 g | 77.45 | 0.26 | 3.98 | 99.74 |

The table indicates that the test exhibits high reproducibility, and the average C content in the peripheral portion (surface region) is 1.5 to 1.6% by mass, while the average C content in the central portion (central region) is about 4.4 to 4.5% by mass. This satisfies the component definitions of DRI for HBI of the present invention. In addition, the average C content of the whole of the reduced iron sample is about 3.9 to 4.0% by mass, and the metallization degree is about 99.7%. This satisfies the preferred component definitions of DRI for HBI of the present invention, i.e., satisfies "the average carbon content of the entire region of reduced iron particles is 1.0 to 5.0% by mass" and "the metallization degree of reduced iron particles is 80% or more". The metallization degree of DRI was measured by chemical analysis of the whole of DRI, while the chemical composition of the whole of DRI was calculated by weighted average of the chemical compositions of the peripheral portion (surface region) and the central portion (central region) of DRI.

Therefore, HBI produced by hot-forming the reduced iron produced as described above is estimated to have sufficient strength, and thus the HBI production test described below was performed for confirmation.

Example 2

Test Method and Condition

The HBI production test was carried out using a rotary hearth furnace (reduced iron production scale: 50 t/d) having an outer diameter of 8.5 m and a hot briquetting machine having a roll diameter of 1 m.

Magnetite ore (iron ore) and bituminous coal (coal) having the compositions shown in Table 4 were used as raw materials, and 80% by mass of iron ore and 20% by mass of coal were mixed. Further, 1.5% of an organic binder was added by exterior. Further, an appropriate amount of water was added, and the raw materials were mixed by a mixer and then pellets incorporated with a carbonaceous material were produced by a pan-type granulator having a diameter of 3.0 m. The pellets incorporated with the carbonaceous material were continuously dried by a band-type dryer adjusted to an atmospheric temperature of 170° C. After drying, the pellets incorporated with the carbonaceous material were continuously charged in the rotary hearth furnace and reduced under the conditions shown in Table 5. The air ratio of a burner provided in the final zone of the rotary hearth furnace was about 1.0. In Table 5, "−190" indicates "furnace pressure of 190 Pa or less".

TABLE 4

| | Chemical composition (% by mass) T.Fe | $Fe_3O_4$ | $SiO_2$ | $Al_2O_3$ | CaO | MgO | LOI | Particle size (% by mass) −74 μm |
|---|---|---|---|---|---|---|---|---|
| Iron ore | 68.8 | 95.11 | 2.06 | 0.57 | 0.55 | 0.44 | 0.71 | 88 |

| | Proximatel analysis (% by mass) Ash | VM | FC | Ultimate analysis (% by mass) S | C | H | O | Particle size −74 μm |
|---|---|---|---|---|---|---|---|---|
| Coal | 9.6 | 18.6 | 71.9 | 0.21 | 81.2 | 4.3 | 4.0 | 80 |

TABLE 5

| | Pellet feed rate (t/h) | Atmospheric temperature (average) (° C.) | Pellet retention time (min) | Furnace pressure (N) |
|---|---|---|---|---|
| Rotary hearth furnace | 3.0 | 1350 | 7.0~9.0 | 190 |

The reduced iron discharged from the rotary hearth furnace was stored in a refractory-lined $N_2$ gas purged container, and the reduced iron of two containers was charged in a hopper installed above the hot briquetting machine each time when each container was filled with the reduced iron. Then, about 2.5 t of reduced iron at a high temperature was supplied to the hot briquetting machine in a batch manner and hot-formed under the conditions shown in Table 6. The formed briquette was cooled by immersion in water to produce hot briquette iron.

TABLE 6

| | DRI feed temperature (° C.) | Roll rotational speed (rpm) | Roll applied pressure (MPa) | Roll torque (N) |
|---|---|---|---|---|
| Hot briquetting machine | 658 | 86 | 16.5 | 378 |

(Test Result)

[Properties of Coal-Based Reduced Iron]

The reduced iron before hot briquetting to HBI was collected and measured with respect to the physical properties. The typical values of the physical properties were compared with those of conventional gas-based reduced iron. The measurement results are shown in Table 7. The table indicates that the coal-based reduced iron has higher contents of carbon (C), gangue, and sulfur (S) than those of gas-based reduced iron because the coal-based reduced iron is produced using coal as a reductant. In addition, the coal composited is removed by gasification to increase porosity and decrease crushing strength.

TABLE 7

| Items | Coal-based DRI | Gas-based DRI |
|---|---|---|
| Metallization degree (%) | 91.0 | 92.0 |
| T. Fe (% by mass) | 85.8 | 92.7 |
| M. Fe (% by mass) | 78.1 | 85.3 |
| C (% by mass) | 3.0 | 1.1 |
| S (% by mass) | 0.08 | 0.01 |
| Gangue content (% by mass) | 7.54 | 3.60 |
| Crushing strength (N/particle) | 412 | 510 |
| Porosity (%) | 65.6 | 62.1 |

Figure 2:
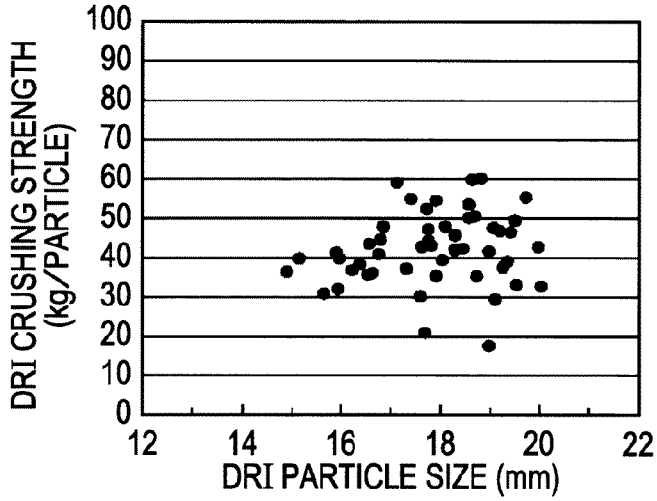
FIG. 2 is a graph showing a relation between the particle size and crushing strength of coal-based DRI.

FIG. 2 shows plots of the particle diameters of 50 coal-based reduced iron particles sampled and crushing strength. As seen from the figure, the strength varies from 20 to 60 kg/particle (about 200 to 600 N/particle) within the particle size range of 16 to 20 mm, and particles having very low strength are present. Since coal-based reduced iron produced with a laboratory-scale small heating furnace are generally uniformly heated, homogeneous reduced iron can be produced. However, in an industrial rotary hearth furnace, reception of heat becomes nonuniform depending on the arrangement of a burner in the rotary heat furnace and overlapping of the pellets incorporated with the carbonaceous material, and the like, thereby causing such variation in quality.

Figure 3:
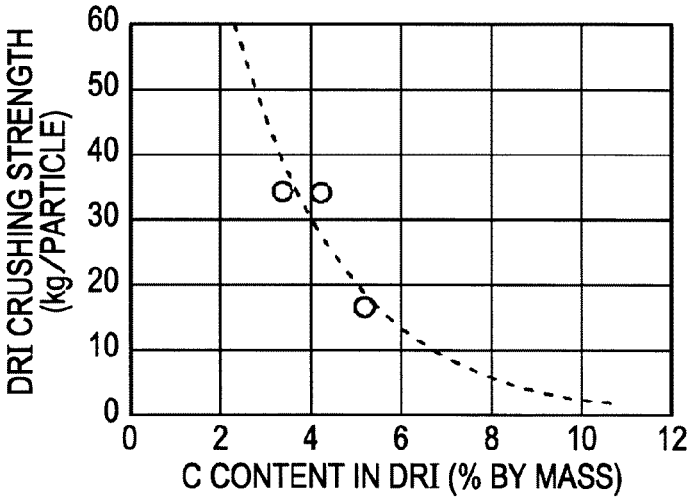
FIG. 3 is a graph showing a relation between the C content and crushing strength of coal-based DRI.

FIG. 3 shows a relation between the C content of the whole of coal-based reduced iron particles and crushing strength. FIG. 3 indicates that the crushing strength decreases as the C content increases.

As a result, it was confirmed that in order to use, as a material to be charged in a blast furnace, coal-based reduced iron in which the C content of the whole particles is increased as much as possible, it is necessary to increase the strength of reduced iron by hot briquetting to HBI.

Figure 4:
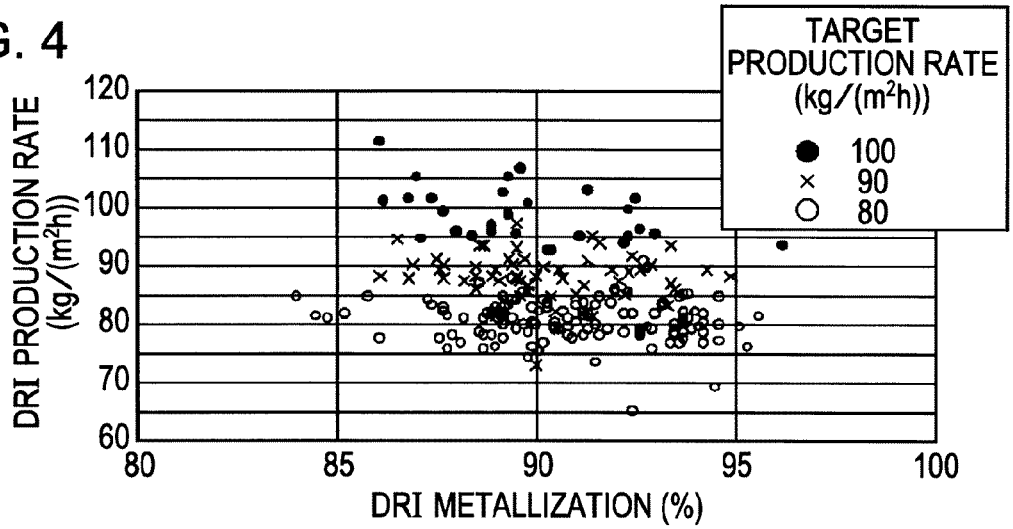
FIG. 4 is a graph showing a relation between the metallization degree and production rate of coal-based DRI in a rotary hearth furnace.

FIG. 4 shows a relation between the metallization degree and production rate of coal-based reduced iron. It is confirmed that when the target production rate is in the range of 80 to 100 kg/($m^2$h), the metallization degree of 80% or more is constantly secured while large variation occurs. The upper limit of the metallization degree can be maximized to about 95% by slightly decreasing the production rate (decreasing the target production rate to 90 kg/($m^2$h) or less). Also, the metallization degree can be controlled by controlling the retention time or the like of the pellets incorporated with the carbonaceous material in the rotary hearth furnace.

[Properties of Coal-Based HBI]

In order to evaluate the strength of coal-based HBI, a drop strength test was carried out. As a method of the drop strength test, like for gas-based HBI, assuming that HBI is transported overseas by a ship or the like, 10 HBI particles were repeatedly dropped five times on an iron plate with a thickness of 12 mm from a height of 10 m. Then, the mass ratio of lumps of a size of 38.1 mm or more (abbreviated to "+38.1 mm" hereinafter) and the mass ratio of powder of a size of 6.35 mm or less (abbreviated to "−6.35 mm" hereinafter) were measured using sieves of mesh sizes of 38.1 mm and 6.35 mm.

Figure 5:
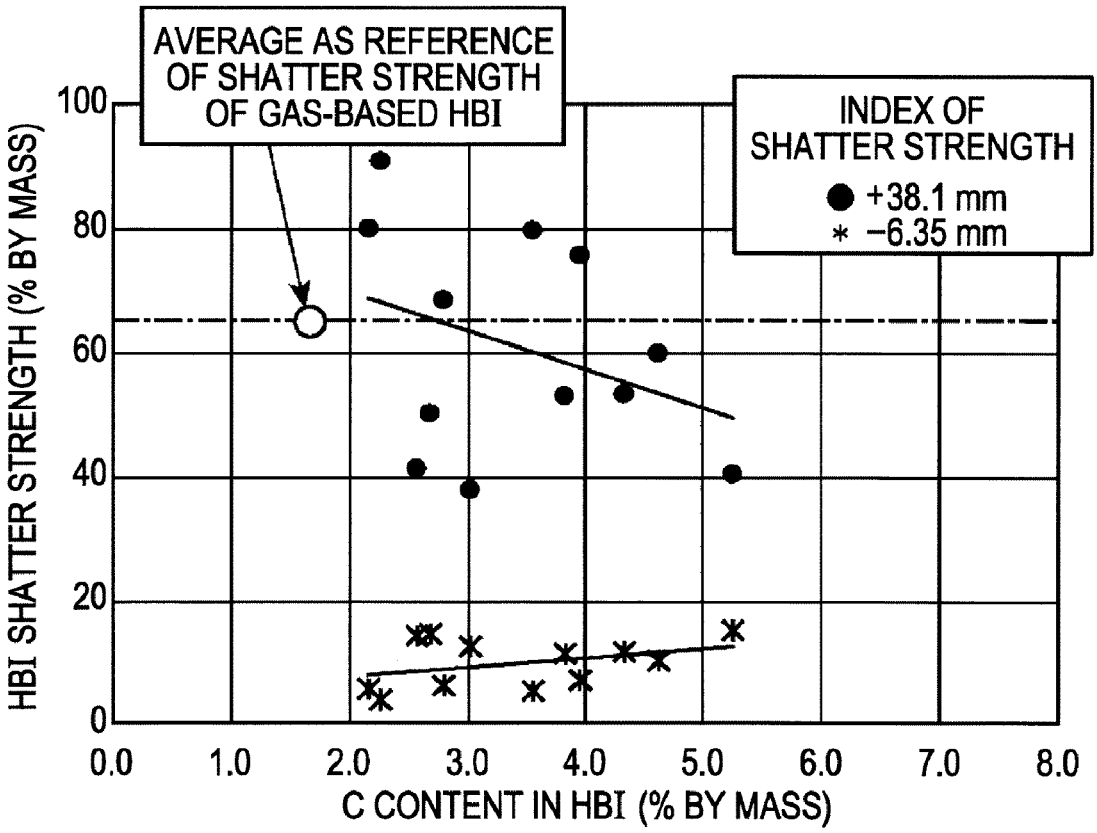
FIG. 5 is a graph showing a relation between the C content and drop strength of coal-based HBI.

FIG. 5 shows a relation between the drop strength and the C content of the whole of coal-based HBI produced by a hot briquetting machine. The figure indicates that when the C content of coal-based HBI (i.e., the average C content of the whole of reduced iron) is in the range of 2.0 to 5.0% by mass, a drop strength (+38.1 mm) substantially satisfying an average (+38.1 mm, 65%) as a reference of drop strength of conventional gas-based HBI can be obtained. In addition, the ratio of −6.35 mm is decreased to about 10%.

Figure 6:
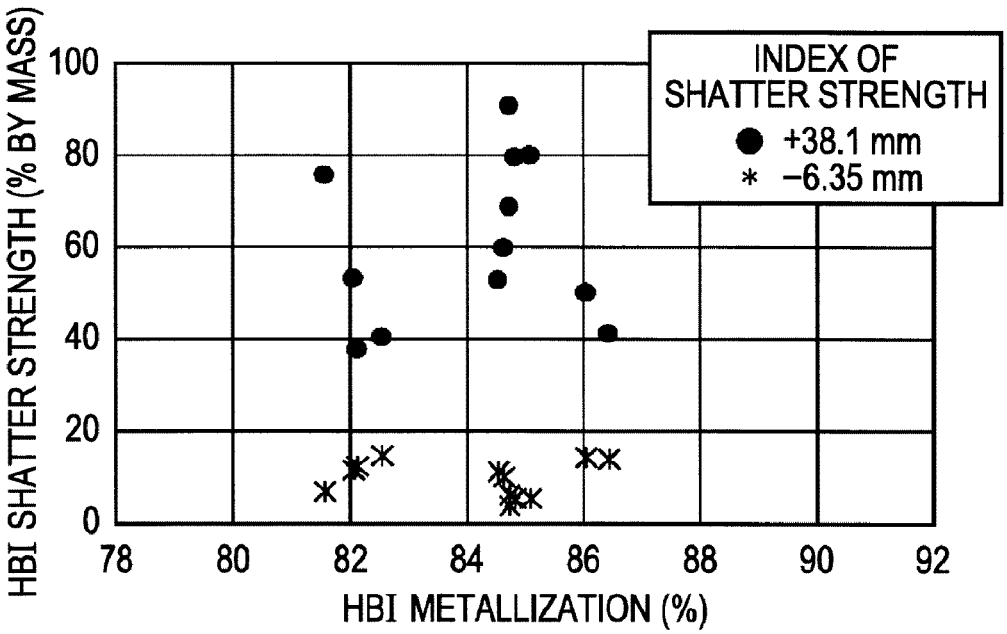
FIG. 6 is a graph showing a relation between the metallization and drop strength of coal-based HBI.

FIG. 6 shows a relation between the metallization degree and drop strength of coal-based HBI. This figure indicates that a specific correlation between the metallization degree and drop strength is not observed, but the drop strength corresponding to that of gas-based HBI can be obtained even at a metallization degree of as low as about 82%.

[Appearance and Internal Structure of Coal-Based HBI]

The coal-based HBI produced in this example has a pillow-like shape having a length of 110 mm, a width of 50 mm, a thickness of 30 mm, and a volume of 105 $cm^3$ and has both ends which are satisfactorily formed and no crack which is easily formed at the ends and referred to as "fish mouth". In addition, the body of HBI is sufficiently thick and thus reduced iron is considered to be pushed at a high pressure.

Figure 7:
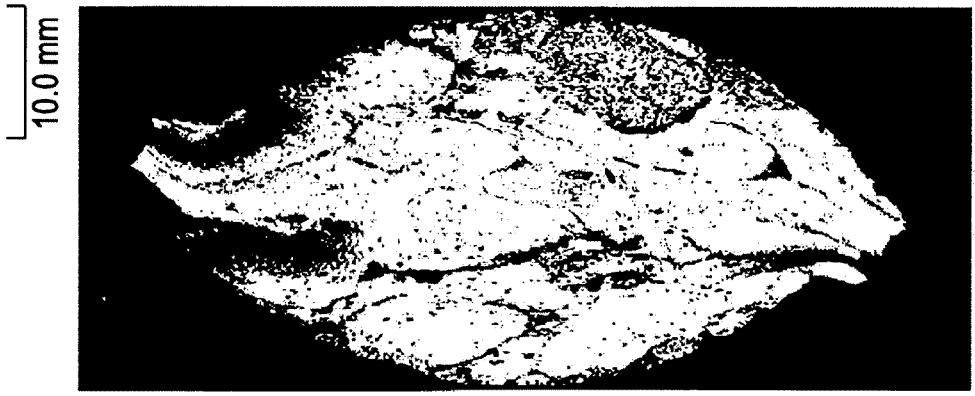
FIG. 7 is a drawing showing a macro-structure of a section of coal-based HBI.

FIG. 7 shows a cross-section of coal-based HBI taken along a direction vertical to a longitudinal direction. In the section, the shape of each reduced iron particle deformed by compression can be seen, and thus it is found that the surfaces of reduced iron particles closely adheres to each other. In the section, the dark surface portion of each reduced iron particle is due to contrasting by etching with an acid for facilitating observation.

[Weather Resistance of Coal-Based HBI]

A weather test of coal-based HBI produced in this example was carried out. As comparative materials, coal-based DRI not hot briquetted to HBI of the present invention and conventional gas-based DRI were used. About 5 kg of each sample was placed in a plastic cage and allowed to stand outdoor (conditions including an average relative humidity of 71.7%, an average temperature of 7.2° C., and a monthly rainfall of 44 mm). A small amount of sample was collected every 2 weeks and examined with respect to the degree of oxidation (decrease in the metallization degree) based on chemical analysis values.

Figure 8:
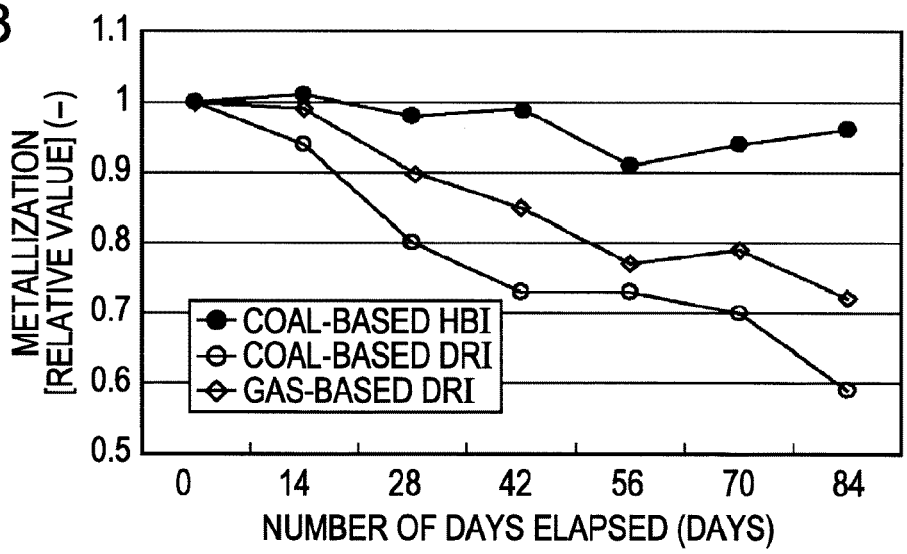
FIG. 8 is a graph showing changes over time of metallization in a weather test.

The results of the examination are shown as a relation between the number of days elapsed and metallization degree (relative value to an initial metallization degree of 1.0) in FIG. 8. The figure indicates that in the case of DRI, the metallization degrees of both coal-based and gas-based DRI significantly decrease to about 60 to 70% of the initial metallization degree after 12 weeks (84 days). In contrast, the metallization degree of coal-based HBI little decreases and a decrease after 12 weeks is about 3% of the initial metallization degree. The weather resistance of DRI and HBI is important particularly from the viewpoint of securing safety in marine transportation. However, in coal-based DRI, re-oxidation occurs during transportation or storage, and heat generation due to the re-oxidation and the danger of ignition are caused. However, since the porosity is significantly deceased by hot briquetting to HBI to densify HBI, the danger can be avoided.

[Influence of Hot-Molding Temperature on Strength of Coal-Based HBI]

Figure 9:
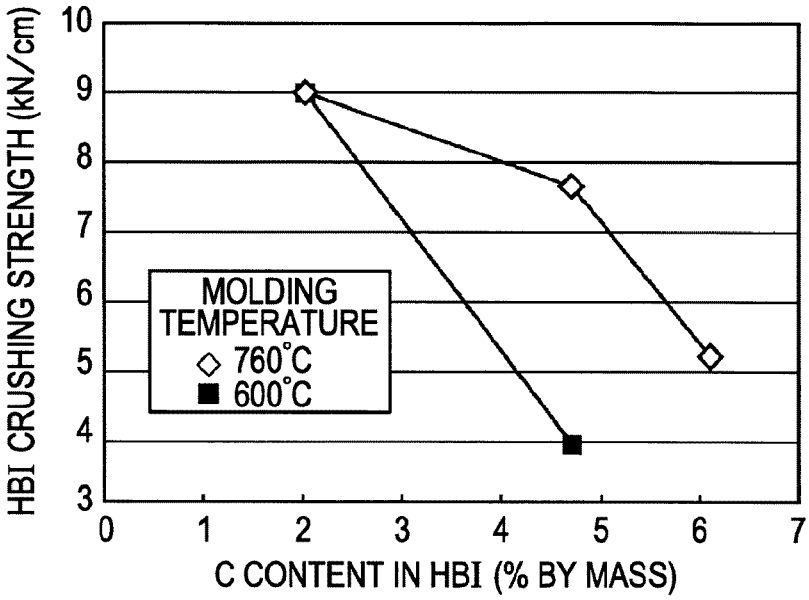
FIG. 9 is a graph showing the influence of a forming temperature on crushing strength of coal-based HBI.

In order to examine the influence of the hot-molding temperature on strength of coal-based HBI, the temperature of coal-based DRI to be supplied to a hot briquetting machine was changed to two levels of a usual temperature of 600° C. and a temperature of 760° C. higher than the usual temperature, coal-based HBI was produced and subjected to measurement of crushing strength. The results of measurement are shown in FIG. 9. The crushing strength of HBI is indicated by a load per HBI width unit length obtained by dividing the load applied in the thickness direction at the time of breakage by the width of HBI. As shown in the figure, when the C content in HBI is as low as about 2% by mass, substantially no influence of the forming temperature is observed. However, when the C content of HBI is increased to about 5% by mass, at the usual forming temperature of 600° C., the crushing strength significantly decreases, while at the forming temperature of 760° C. higher than the usual temperature, a decrease in crushing strength is very small. Therefore, it was confirmed that HBI having a high C content and high strength can be produced by forming at a higher temperature.

As described above, hot briquette iron in an aspect of the present invention includes a plurality of reduced iron particles which are bonded to each other by hot forming, the reduced iron particles each having a surface region having an average carbon content of 0.1 to 2.5% by mass and a central region positioned inside the surface region and having an average carbon content higher than that of the surface region. The reduced iron particles may be granular or pellet reduced iron or briquette reduced iron, and the shape of reduced iron is not limited to a granular shape.

The surface region of the hot briquette iron of the present invention is preferably a region from the surface of the reduced iron particle to a depth of 3 mm.

In the hot briquette iron of the present invention, the average C content in the surface region is limited to 0.1 to 2.5% by mass, and thus the strength of the hot briquette iron can be secured while maintaining adhesive force between the reduced iron particles. Therefore, the hot briquette iron of the present invention has strength as a raw material to be charged in a blast furnace and weather resistance. Also, since coal-based DRI produced using a carbonaceous material, such as inexpensive coal, as a reductant and a low-grade iron oxide source as a raw material can be used, the cost of the hot briquette iron of the present invention is lower than gas-based HBI.

In the hot briquette iron of the present invention, the average carbon content in the whole region of the reduced iron particle is preferably 1.0 to 5.0% by mass.

Therefore, since the average C content in the whole of reduced iron particles in the hot briquette iron of the present invention is set in a high value range, it is possible to prevent re-oxidation with $CO_2$-rich furnace gas in a blast furnace shaft portion and facilitate carburization into metallic iron in a high temperature portion of a blast furnace, accelerating melt-down and improving air permeability in the blast furnace.

In the hot briquette iron of the present invention, the metallization degree of the reduced iron particles is preferably 80% or more.

Therefore, since the metallization degree of the reduced iron particles in the hot briquette iron is set to a high value of 80% or more, when the hot briquette iron is used as a raw material to be charged in a blast furnace, it is possible to increase the productivity of the blast furnace and decrease the ratio of a reducing material (fuel ratio) in the blast furnace, thereby decreasing the amount of exhaust $CO_2$.

A method for producing hot briquette iron in another aspect of the present invention includes an agglomeration step of granulating agglomerates incorporated with a carbonaceous material the agglomerates containing an iron oxide content and a carbonaceous material, a heat reduction step of heat-reducing the agglomerates incorporated with the carbonaceous material in a reducing furnace to produce reduced iron particles each having an average carbon content of 0.1 to 2.5% by mass in a surface region and a higher average carbon content in a central region than that in the surface region, a discharge step of discharging the reduced iron particles from the reducing furnace, and a hot forming step of compression-molding the plurality of the reduced iron particles discharged from the reducing furnace with a hot-forming machine.

Therefore, the agglomerates incorporated with the carbonaceous material, which contain the carbonaceous material such as inexpensive coal as a reductant and a low-grade iron oxide source are heat-reduced to produce coal-based reduced iron particles, and the hot briquette iron is produced from the reduced iron particles using a hot forming machine. Therefore, it is possible to secure the strength of the hot briquette iron while maintaining adhesive force between the reduced iron particles. As a result, hot briquette iron which can be actually used as a raw material to be charged in a blast furnace and which has low cost and high strength and weather resistance can be provided.

In the method for producing the hot briquette iron of the present invention, the reduced iron particles discharged are preferably compression-molded in the hot forming step without being substantially cooled.

Therefore, the reduced iron particles can be compression-molded in a softened state at a high temperature, and thus it is possible to secure strength of the hot briquette iron even when the average C content in the whole of the reduced iron particles is high.

In the method for producing the hot briquette iron of the present invention, in the agglomeration step, the iron oxide content and the carbonaceous material are preferably mixed at such a ratio that the average C content in the entire region of the reduced iron particles is 1.0 to 5.0% by mass. Also, in the heat reduction step, the agglomerates incorporated with the carbonaceous material are preferably heat-reduced under a condition in which the average C content in the entire region of the reduced iron particles is 1.0 to 5.0% by mass.

According to the production method, the average C content in the surface region of the reduced iron particles can be more precisely controlled, and thus the hot briquette iron of the present invention can be more securely obtained.

In the method for producing the hot briquette iron of the present invention, in the agglomeration step, the iron oxide content and the carbonaceous material are preferably mixed at such a ratio that the metallization degree of the reduced iron particles is 80% or more. Also, in the heat reduction step, the agglomerates incorporated with the carbonaceous material are preferably heat-reduced under a condition in which the metallization degree of the reduced iron particles is 80% or more.

According to the production method, since the metallization degree of the whole of the reduced iron particles is as high as 80% or more, when the hot briquette iron prepared using the reduced iron particles is used as a raw material to be charged in a blast furnace, it is possible to increase the productivity of the blast furnace and decrease the ratio of the reducing material (fuel ratio) in the blast furnace, thereby decreasing the amount of exhaust $CO_2$.

Also, in the method for producing the hot briquette iron of the present invention, the degree of oxidation of a gas atmosphere in the reducing furnace is preferably changed at the time of termination of the heat reduction step. Also, the reduced iron particles discharged are preferably brought into contact with oxidizing gas after the discharge step.

According to the production method of the present invention, the metallization degree of the reduced iron particles can be increased. Therefore, when the hot briquette iron produced using the reduced iron particles is used as a raw material to be charged in a blast furnace, it is possible to increase the productivity of the blast furnace and decrease the ratio of the reducing material (fuel ratio) in the blast furnace, thereby decreasing the amount of exhaust $CO_2$.

A method for producing hot briquette iron in another aspect of the present invention is a method for producing hot briquette iron including a plurality of reduced iron particles, the method including compression-molding reduced iron particles with a hot forming machine, the reduced iron particles each including a surface region having an average carbon content of 0.1 to 2.5% by mass and a central region disposed inside the surface region and having a higher average carbon content than that in the surface region.

Thus, since the reduced iron particles each having an average C content of 0.1 to 2.5% by mass in the surface region are compression-molded, the hot briquette iron can maintain adhesive force between the reduced iron particles. As a result, hot briquette iron having strength as a raw material to be charged in a blast furnace and weather resistance can be produced. In addition, coal-based DRI produced using a carbonaceous material, such as inexpensive coal, as a reductant and a low-grade iron oxide source as a raw material can be used as the reduced iron particles. Therefore, hot briquette iron more inexpensive than gas-based HBI can be produced.

In the method for producing the hot briquette iron of the present invention which includes a plurality of reduced iron particles, the average C content in the entire region of the reduced iron particles is preferably 1.0 to 5.0% by mass.

According to the production method, the average C content in the surface region of the reduced iron particles can be more precisely controlled, and thus the hot briquette iron of the present invention can be more securely obtained.

In the method for producing the hot briquette iron of the present invention which includes a plurality of reduced iron particles, the metallization degree of the reduced iron particles is preferably 80% or more.

According to the production method, since the metallization degree of the whole of the reduced iron particles is as high as 80% or more, when the hot briquette iron produced using the reduced iron particles is used as a raw material to be charged in a blast furnace, it is possible to increase the productivity of the blast furnace and decrease the ratio of the reducing material (fuel ratio) in the blast furnace, thereby decreasing the amount of exhaust $CO_2$.

Further, the hot briquette iron according to the present invention is suitable as particularly a raw material to be charged in a blast furnace, but use as a raw material for an electric furnace is not excluded. In particular, in hot briquette iron having an average carbon content of 1.0 to 5.0% by mass over the entire region of reduced iron particles, the C content can be increased to be higher than that of HBI composed of conventional gas-based DRI. Although there is the need to treat slag content and sulfur content, use in an electric furnace is worthy of investigation because of the high effect of decreasing the power consumption.

The invention claimed is:

1. Hot briquette iron comprising a plurality of heating-reduced iron particles with a residual carbon content from carbonaceous material incorporated as a reductant, which particles are bonded to each other by hot forming, wherein the heating-reduced iron particles each have a surface region having an average carbon content of 0.1 to 2.5% by mass of the surface region mixed in the surface region and a central region positioned inside the surface region and having an average carbon content of percent by mass of the central region higher than the average carbon content of percent by mass of the surface region, and wherein the total average carbon content of each of the heating-reduced iron particles is 1.0 to 5.0% by mass.

2. The hot briquette iron according to claim 1, wherein the surface region is a region from the surface of the heating-reduced iron particles to a depth of 3 mm.

3. The hot briquette iron according to claim 1 or 2, wherein the heating-reduced iron particles have a metallization degree of 80% or more.

4. The hot briquette iron according to claim 1, wherein the carbonaceous material incorporated as a reductant in the heating-reduced iron particles is selected from the group consisting of coal, coke, charcoal, wood chips, waste plastic, scrap tire, and blast furnace dust.

5. The hot briquette iron according to claim 1, wherein the carbonaceous material incorporated as a reductant in the heating-reduced iron particles is coal powder.

6. The hot briquette iron according to claim 1, wherein the average carbon content in the surface region of the heating-reduced iron particles ranges from 0.5% by mass to 2.0% by mass of the surface region.

7. The hot briquette iron according to claim 1, wherein the total average carbon content of each of the heating-reduced iron particles is 2.0 to 4.5% by mass.

8. The hot briquette iron according to claim 1, wherein the total average carbon content of each of the heating-reduced iron particles is 3.0 to 4.5% by mass.

* * * * *